US009862194B2

(12) United States Patent
Gaston Llado et al.

(10) Patent No.: US 9,862,194 B2
(45) **Date of Patent: *Jan. 9, 2018**

(54) PRINTHEAD WIPING

(71) Applicant: Hewlett-Packard Development Company, L.P., Houston, TX (US)

(72) Inventors: Gonzalo Gaston Llado, Barcelona (ES); Marta Coma Vives, Barcelona (ES); Antonio Gracia Verdugo, Barcelona (ES); Joan Albert Jorba Closa, Barcelona (ES); Ezequiel Jordi Rufes Bernad, Barcelona (ES); Xavier Gras Gros, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/116,881

(22) PCT Filed: Feb. 19, 2014

(86) PCT No.: PCT/US2014/017165
§ 371 (c)(1),
(2) Date: Oct. 12, 2016

(87) PCT Pub. No.: WO2015/126385
PCT Pub. Date: Aug. 27, 2015

(65) Prior Publication Data

US 2017/0173963 A1 Jun. 22, 2017

Related U.S. Application Data

(63) Continuation of application No. PCT/US2014/016806, filed on Feb. 18, 2014.

(51) Int. Cl.
*B41J 2/165* (2006.01)

(52) U.S. Cl.
CPC ..... *B41J 2/16535* (2013.01); *B41J 2/16538* (2013.01); *B41J 2/16541* (2013.01);
(Continued)

(58) Field of Classification Search
CPC ..... B41J 2/16552; B41J 2/16535
See application file for complete search history.

(56) References Cited

U.S. PATENT DOCUMENTS 5,432,539 A 7/1995 Anderson
5,870,116 A 9/1999 Kyoshima
(Continued)

FOREIGN PATENT DOCUMENTS

KR 100750086 8/2007

OTHER PUBLICATIONS

Weink; Cleaning Service Stations in Your Inkjet Printer Keeps Print Heads Healthy—TSN19; http://www.weink.com/Support/html_whitepapers/tsn19.htm >; Jul. 31, 2004.

*Primary Examiner* — Jason Uhlenhake
(74) *Attorney, Agent, or Firm* — HP Inc. Patent Department

(57) ABSTRACT

In one example, a method for wiping the face of a printhead includes wiping across the face of the printhead and then wiping along the face of the printhead with a web of cleaning material. In another example, a wiper for wiping a face of a printhead includes a rotatable shaft having an axis of rotation and a helical blade affixed to the shaft. The helical blade is simultaneously rotatable on the shaft against the face of the printhead and translatable along the face of the printhead in a direction parallel to the axis of rotation.

14 Claims, 15 Drawing Sheets

(52) U.S. Cl.
CPC ..... *B41J 2/16547* (2013.01); *B41J 2/16588* (2013.01); *B41J 2002/1655* (2013.01); *B41J 2002/16558* (2013.01); *B41J 2002/16573* (2013.01)

(56) References Cited

U.S. PATENT DOCUMENTS

| | | | |
|---|---|---|---|
| 6,530,643 | B1 | 3/2003 | Askren et al. |
| 6,598,955 | B1 | 7/2003 | Tee et al. |
| 2004/0130588 | A1 | 7/2004 | Nakagawa et al. |
| 2004/0227704 | A1 | 11/2004 | Lodal et al. |
| 2005/0062796 | A1 | 3/2005 | Mott et al. |
| 2009/0141076 | A1 | 6/2009 | Mull et al. |
| 2009/0179951 | A1 | 7/2009 | Hibbard et al. |

PRINTHEAD WIPING

BACKGROUND

Inkjet printers use printheads with tiny nozzles to dispense ink or other printing fluid on to paper or other print substrates. In a scanning type inkjet printer, a single printhead or multiple printheads are scanned back and forth over the print substrate dispensing printing fluid in swaths as the substrate is advanced past the printhead(s). Inkjet printers usually include a service station adjacent to the scan path to clean and protect the printheads. The service station may include a capping system to seal the printheads during periods of non-use, a spittoon to collect fluid "spit" from nozzles to inhibit clogging, and a wiper to wipe printing fluid and debris away from the nozzles.

DRAWINGS

FIG. 3 shows the printer with the printhead carriage and service doors open and the service module exploded out, away from the printer housing.

The same part numbers designate the same or similar parts throughout the figures.

DESCRIPTION

It has been discovered that certain combinations of latex ink and printhead architecture increase the incidence of ink puddling on the exposed face of the printheads surrounding the ink dispensing nozzles. Ink puddles can block nozzles and thus cause unwanted streaks in the printed image. Periodically wiping the printhead during printing to avoid ink puddling on the printhead face sometimes makes streaking worse by dragging stale ink over the nozzles, clogging many nozzles at the beginning of each swath after cleaning the printhead with the web wiper.

A new printhead service system has been developed to help reduce streaking caused by web wiping ink puddles. In one example, the service system includes a web wiper to wipe along the face of the printhead (perpendicular to the printhead scanning direction) and a preliminary wiper to wipe across the face of the printhead (in the printhead scanning direction) before web wiping. Pre-wiping across the face of the printhead helps remove puddles to make the subsequent web wiping more effective and thus reduce the risk of streaking.

The preliminary wiper may be implemented, for example, as a stationary wiping blade positioned across the printhead scan path to wipe across the face of the printheads as the printheads pass over the blade. The use of a stationary wiper blade across the scan path allows cross wiping the printheads on each pass of the printhead carriage back and forth across the print substrate or periodically after multiple passes by controlling the position of the carriage on each pass. Accordingly, the stationary cross wiper may be used independent of the web wiper, which usually will be deployed only after multiple carriage passes, or with the web wiper to clear puddles off the face of the printheads preliminary to web wiping. In another example, the preliminary wiper is implemented as a helical wiper blade that simultaneously rotates against and translates along the face of the printhead to wipe ink off to the side of the printhead just before wiping with the cleaning web. A helical pre-wiper may be used in addition to or in place of a stationary cross wiper.

The examples shown in the figures and described herein illustrate but do not limit the disclosure, which is defined in the Claims following this Description.

As used in this document: "rotate" means to turn about an axis; "translate" means to move in a straight line; a "printhead" means that part of an inkjet printer or other inkjet type dispenser that dispenses fluid, for example as drops or streams; "printing fluid" means fluid that may be dispensed with a printhead; and a "web" means a sheet, strip or roll of material. A "printhead" is not limited to printing with ink but also includes inkjet type dispensing of other fluid and/or for uses other than printing.

Figure 1:
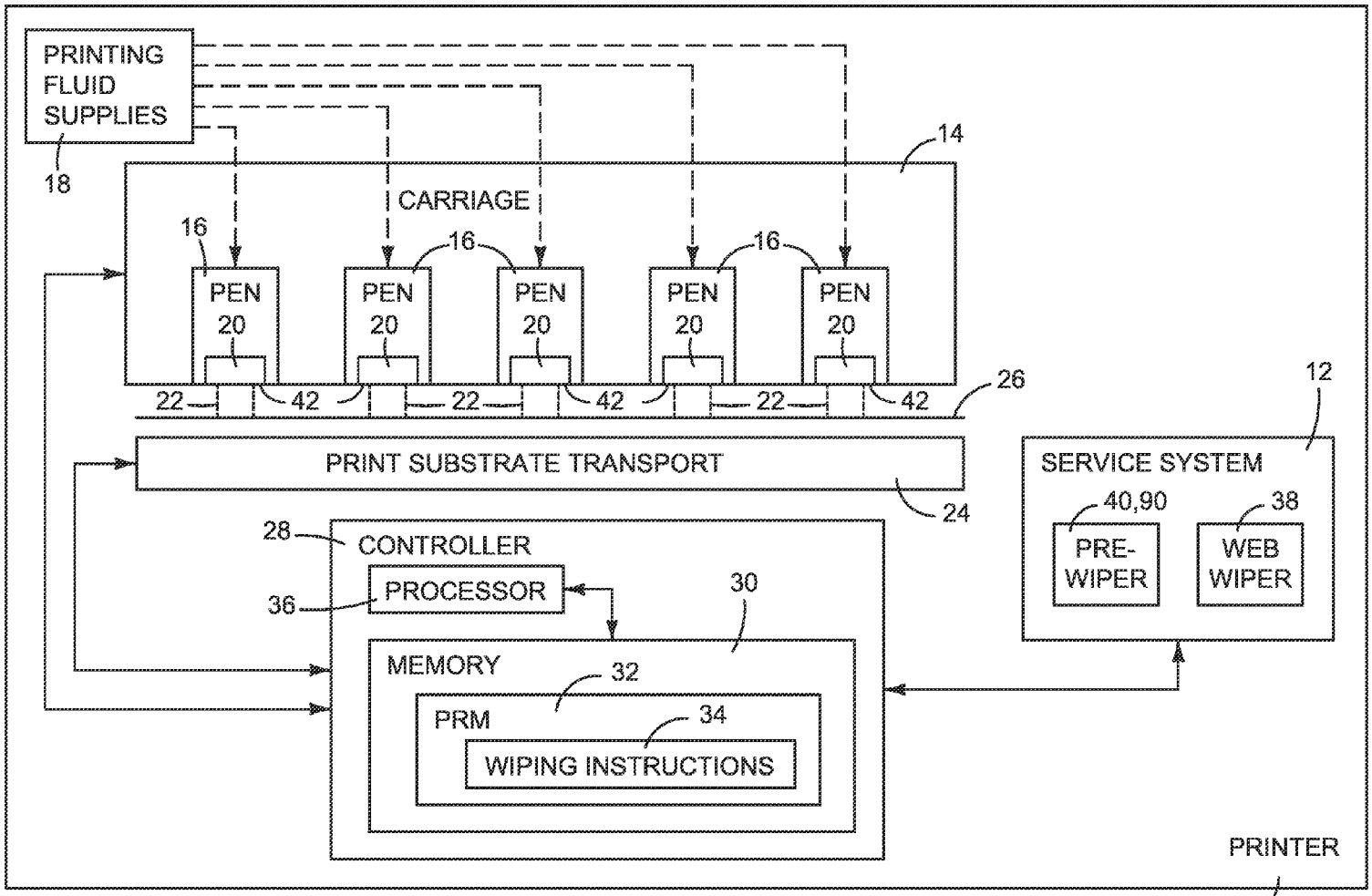
FIG. 1 is a block diagram illustrating an inkjet printer implementing one example of a new printhead service system.

FIG. 1 is a block diagram illustrating an inkjet printer 10 implementing one example of a printhead service system 12. Referring to FIG. 1, printer 10 also includes a carriage 14 carrying multiple ink pens 16 connected to printing fluid supplies 18. Inkjet ink pens 16 are also commonly referred to as ink cartridges or print cartridges and may dispense ink and other printing fluids from a printhead or multiple printheads 20 contained within each pen 16, for example as drops or streams 22. A transport mechanism 24 advances a paper or other print substrate 26 past carriage 14 and ink pens 16. A controller 28 is operatively connected to service system 12, carriage 14, printheads 20 and substrate transport 24. Controller 28 represents the programming, processor(s) and associated memory(ies), and the electronic circuitry and components needed to control the operative elements of printer 10. In particular, controller 28 includes a memory 30 having a processor readable medium (PRM) 32 with instructions 34 for controlling the wiping functions of printhead service system 12 and a processor 36 to read and execute instructions 34. Control functions for many printers, particularly printers for small business and personal use, are implemented in application specific integrated circuits (ASICs). Accordingly, some or all of the functionality of controller 28 in printer 10, including PRM 32, wiping instructions 34 and processor 36 may be implemented in an ASIC. However, other suitable implementations for PRM 32, instructions 34 and processor 34 may be used.

Carriage 14 with pens 16 illustrates just one example of a printhead assembly that may be used with service system 12. Other types of printhead assemblies are possible. For example, instead of ink pens 16 with integrated printheads 20 shown in FIG. 1, the printhead(s) could be mounted separately on carriage 14 with replaceable ink containers operatively connected to the carriage mounted printhead(s). Also, although remote printing fluid supplies 18 are shown, the printing fluids could be located on carriage 14 or contained within each pen 16.

Printhead service system 12 in FIG. 1 includes a web wiper 38 and a preliminary wiper 40 each to wipe the exposed face 42 of printheads 20. A "preliminary" wiper in this context means a wiper that wipes before the web wiper in a printhead wiping sequence. The printhead dispensing nozzles exposed at face 42 are often formed in a thin flat plate commonly called a "nozzle plate" or "orifice plate", and reference made simply to wiping the nozzle plate or wiping the orifice plate to describe the act of wiping the exposed face of the printhead.

Figure 2:
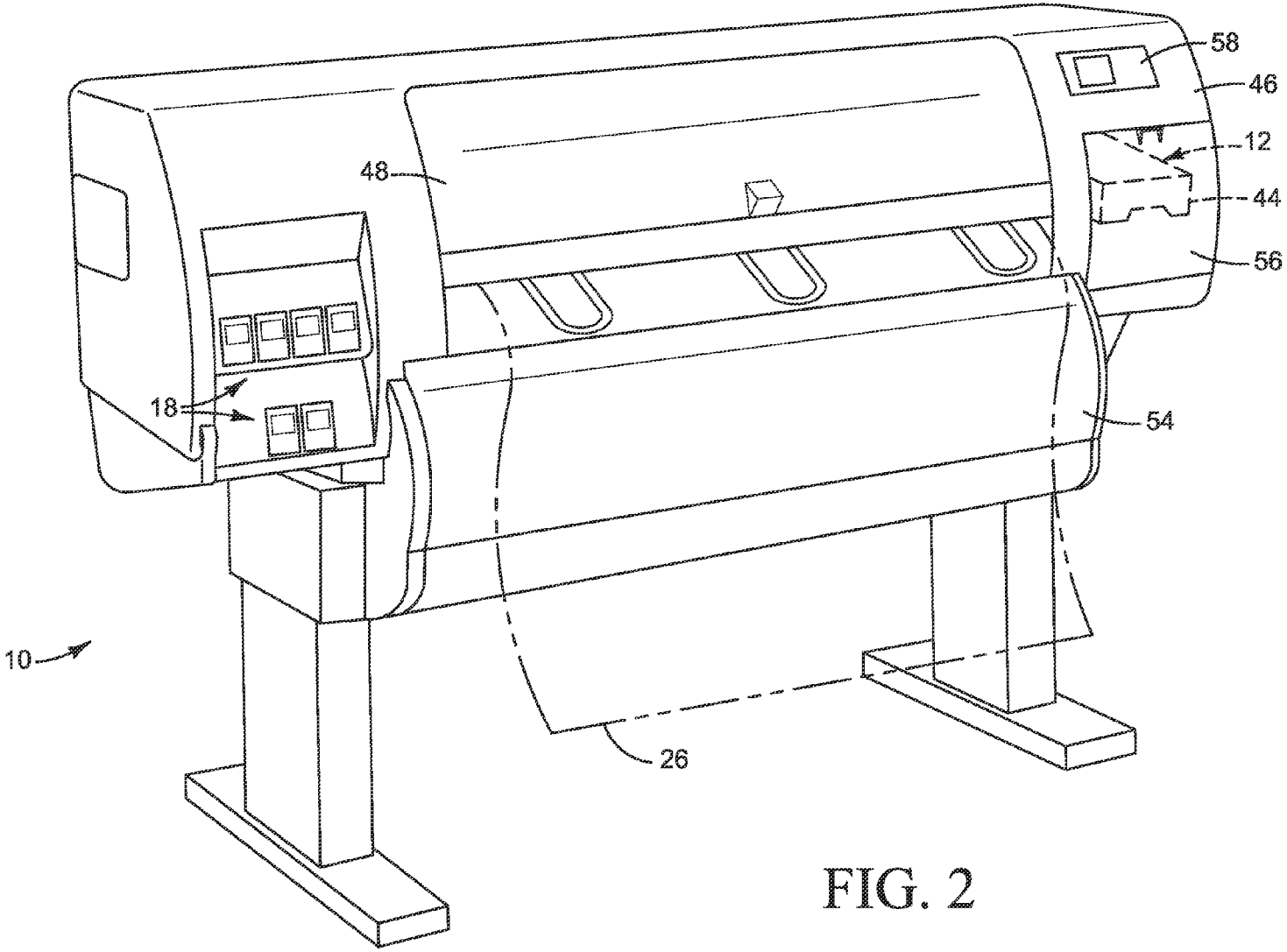
FIGS. 2 and 3 are perspective views illustrating a large format inkjet printer implementing one example of a printhead service system, such as the system shown in FIG. 1, in which the wipers are housed together in a removable service module.
Figure 3:
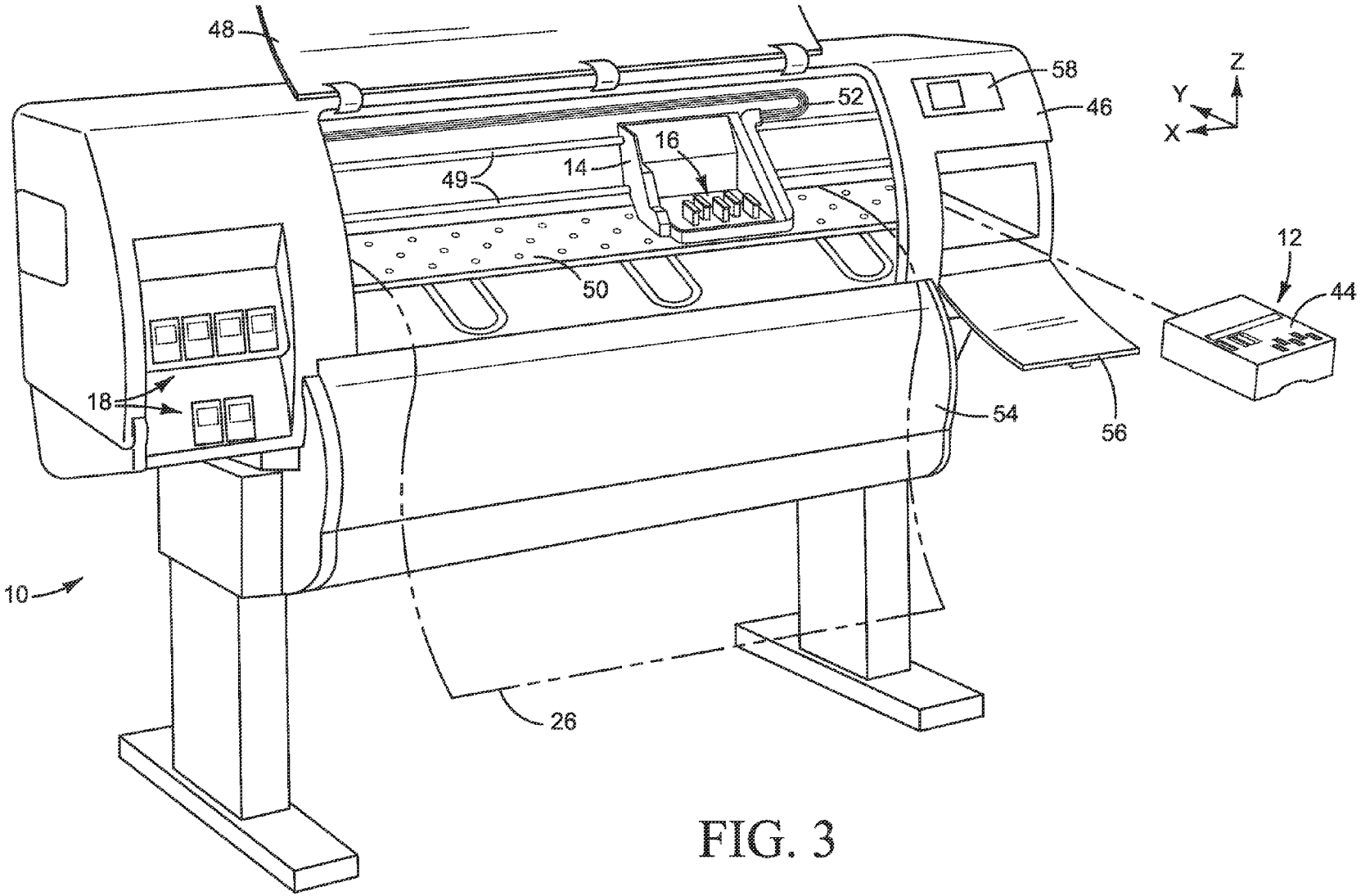
Figure 4:
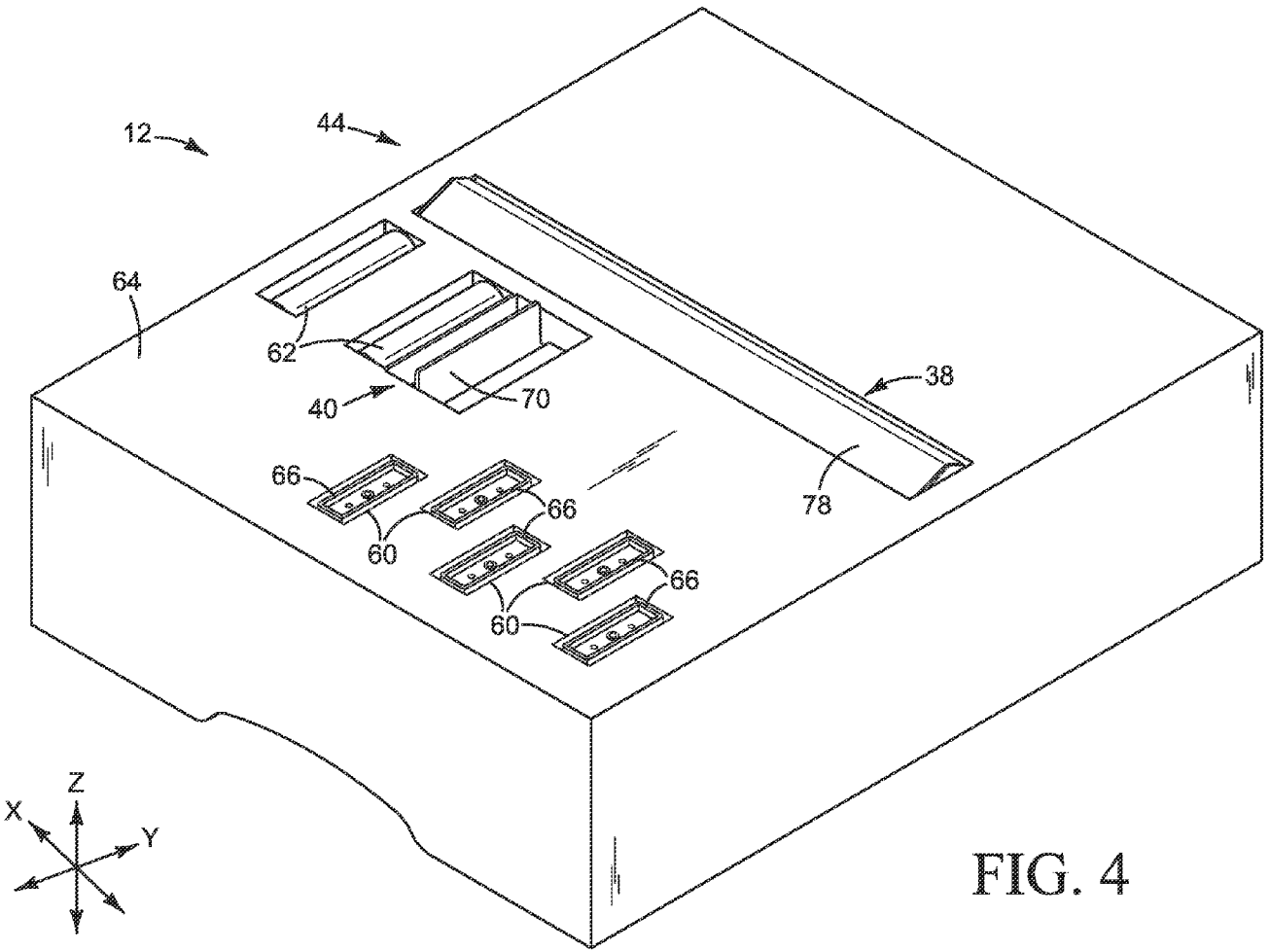
FIG. 4 is a close-up view of the service module in the printer shown in FIGS. 2 and 3.
Figure 5:
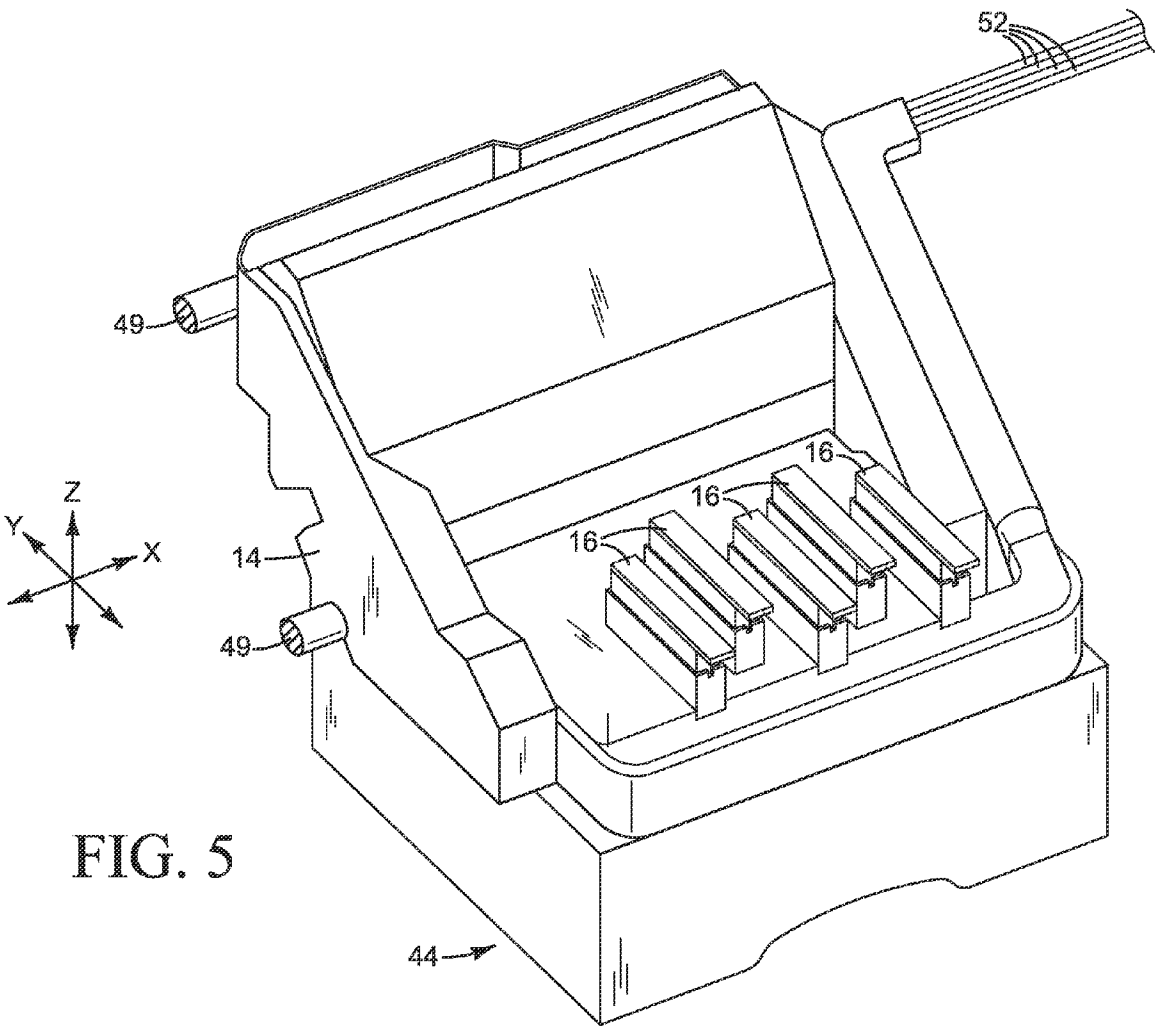
FIGS. 5 and 6 are close-up views of the printhead carriage and service module in the printer shown in FIGS. 2 and 3 with the printhead carriage parked over the service module. The printhead carriage is exploded away from the service module in FIG. 6 to show the nozzle plate on the bottom of each printhead.
Figure 6:
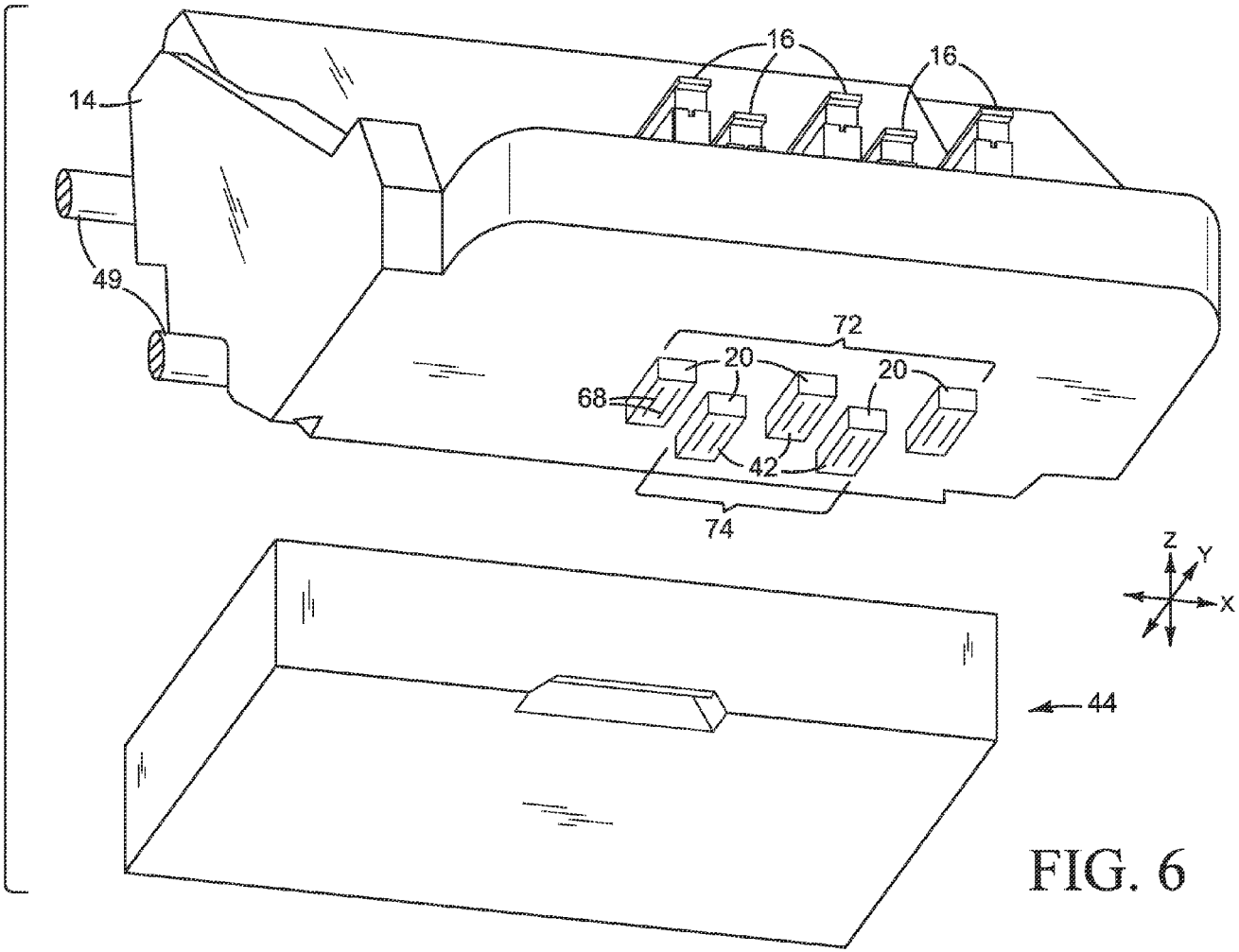

FIGS. 2 and 3 illustrate a large format inkjet printer 10 implementing one example of a printhead service system 12 in which wipers 38 and 40 are housed together in a removable service module 44. FIG. 4 is a close-up view of service module 44. FIGS. 5 and 6 are close-up views of printhead carriage 14 parked over service module 44. Carriage 14 is exploded away from service module 44 in FIG. 6 to show the nozzle plate on the bottom of each printhead 20. Referring first to FIGS. 2 and 3, carriage 14 carrying ink pens 16 is enclosed in a printing housing 46. Carriage 14 may be accessed through a door 48 in housing 46. Door 48 is closed in FIG. 2, hiding carriage 14 and ink pens 16. Door 48 is open in FIG. 3 to show carriage 14 and pens 16. As shown in FIG. 3, carriage 14 slides along rails 49 over a platen 50. Platen 50 supports a print substrate web 26 as it passes under carriage 14 for printing with pens 16. Only the outline of print substrate 26 is depicted in FIGS. 2 and 3 with phantom lines so that the substrate does not hide other parts of printer 10. Printer 10 also includes ink supply containers 18 supported in housing 46 and connected to pens 16 through flexible tubing 52. A supply roll (not shown) of web substrate 26 is supported in a lower part 54 of housing 46. Printhead service module 44 is positioned at one end of platen 50 and accessed through a door 56 in housing 46. Printer 10 may also include a local display and control panel 58.

Referring now to FIGS. 4-6, printhead service module 44 includes a group of caps 60, a pair of spit rollers 62, a web wiper 38 and a preliminary wiper 40 supported in a module housing 64. Each cap 60 includes an elastomeric seal 66 that surrounds and seals the dispensing nozzles 68 (FIG. 6) on each printhead 20 when caps 60 are applied to printhead faces 42 during periods of printer inactivity. Disposable spit rollers 62 may have an absorbent outer layer to collect ink during periodic spitting that helps prevent and clear clogged nozzles. In this example, preliminary wiper 40 is implemented as a stationary cross wiper that includes a flat blade 70 supported in module housing 64 across the scan path of printheads 20 during cross wiping. "Stationary" in this context means blade 70 is stationary during cross wiping.

Figure 7:
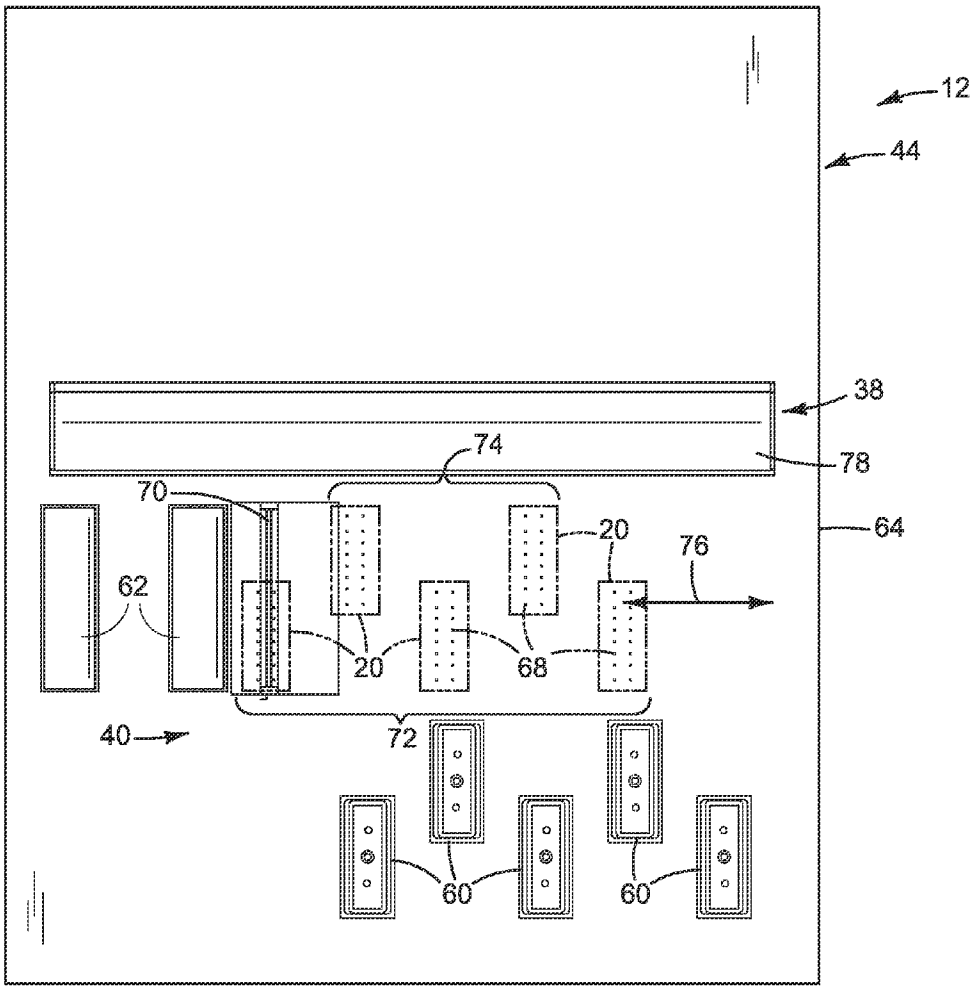
FIGS. 7 and 8 is a plan and end views, respectfully, showing a printhead over the stationary cross wiper in the service module of FIG. 4.
Figure 7:
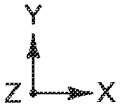
Figure 8:
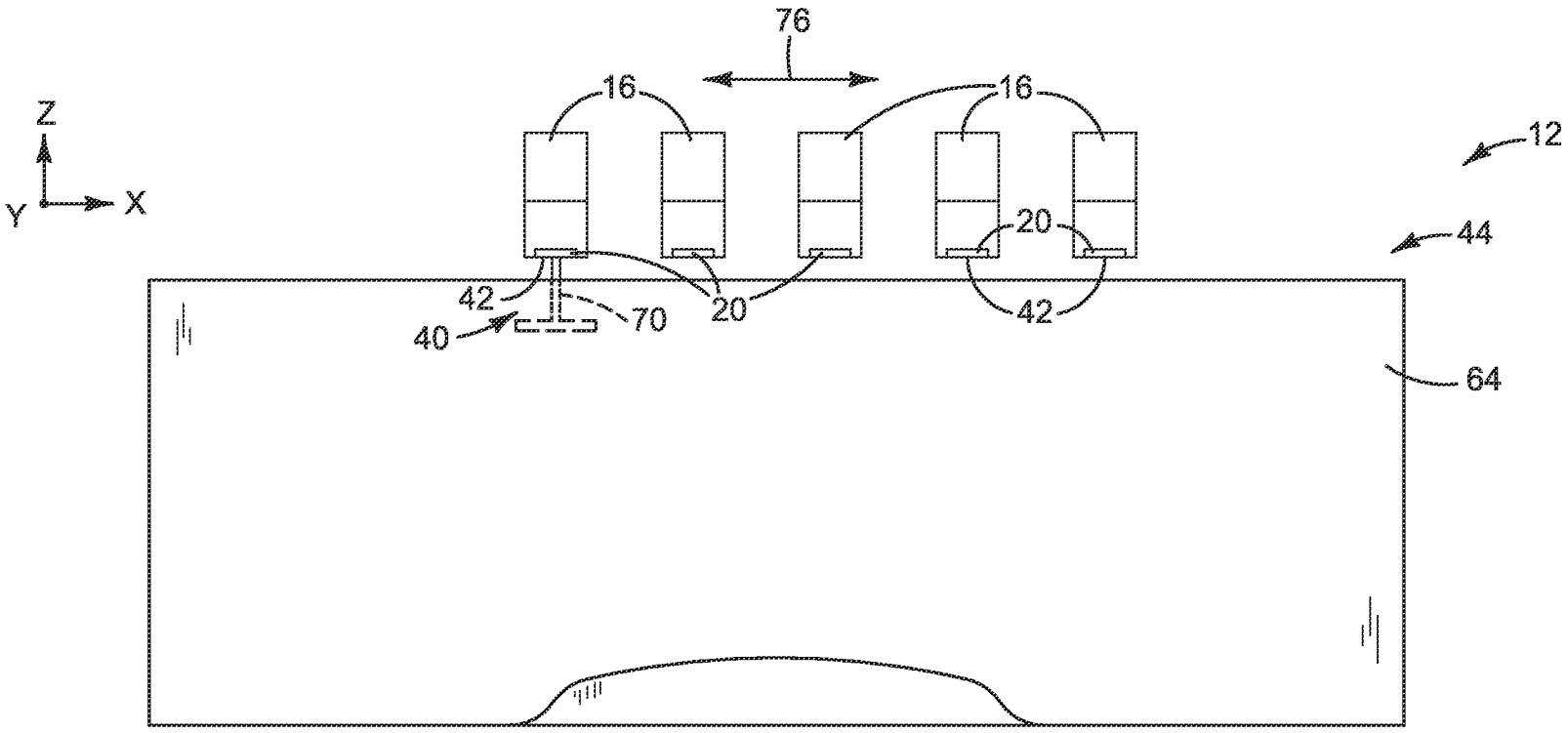

FIGS. 7 and 8 are plan and end views, respectively, showing printheads 20 over cross wiper 40 in service module 44. Referring to FIGS. 4-8, in this example of cross wiper 40, a single blade 70 spans the scan path for both groups 72, 74 of printheads 20 staggered in the Y direction. The outline of the nozzle plate of each printhead 20 along the scan path is depicted with phantom lines in the plan view of FIG. 7. Cross wiper blade 70 is fixed in module 44 so that it moves with module 44 (in the Y direction) and not independent of module 44. Other configurations are possible. For example, two stationary blades could be used with each spanning the scan path of a corresponding group 72, 74 of staggered printheads 20 or the blade(s) 70 made to move for positioning independent of module 44. For another example, and where cross wiping all the printheads after each pass of carriage 14 back and forth across substrate 22 is not desired, a single stationary blade 70 spanning only one scan path could be used, moving the single blade into each printhead scan path as desired to wipe the corresponding printheads.

In operation, module 44 is moved in the Y direction to position cross wiper blade 70 in the path of printheads 20 moving on carriage 14 in the X direction, as best seen in FIG. 7. Thus, printhead carriage 14 carries printheads 20 over blade 70 to wipe ink across the printhead face 42, perpendicular to the line of dispensing nozzles 68, to avoid dragging ink along the nozzles. The movement of carriage 14 back and forth over blade 70 is indicated by arrows 76 in FIGS. 7 and 8. Cross wiping in line with the scan path every printing pass of carriage 14 back and forth across substrate 22 helps maintain good print quality without any significant reduction in printing speed. Also, wiping printhead surfaces 42 every pass helps reduce the frequency with which more thorough cleaning with web wiper 38 may be performed, thus extending the useful life of the web.

The number of printheads 20 cross wiped and frequency of cross wiping is controlled by carriage 14. For example, all five printheads 20 may be cross wiped on each pass of carriage 14 back and forth across platen 50 during printing. For another example, carriage 14 may carry printheads 20 over cross wiper 40 on fewer than every pass and/or for wiping fewer than all printheads 20 (beginning with the outboard most printheads in the X direction). Cross wiping helps keep printhead faces 42 clear of ink puddles during printing and helps make periodic web wiping more effective. While it is expected that cross wiping usually will be performed more frequently than web wiping, for example cross wiping every pass of carriage 14 during printing compared to web wiping after multiple passes during printing, other suitable wiping scenarios are possible.

Figure 9:
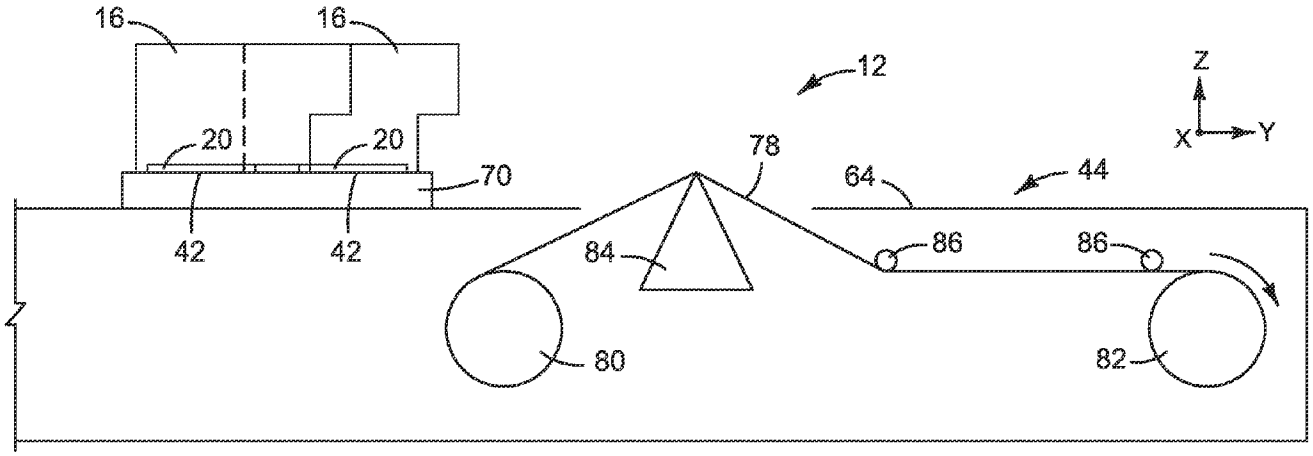
FIGS. 9-12 are side views showing one example of a wiping sequence with the service module of FIG. 4.

Referring now also to the side views of FIGS. 9-12, web wiper 38 includes a web 78 of absorbent or other suitable cleaning material that extends from a supply spool 80 to a take-up spool 82. In the example shown, cleaning material web 78 extends over a blade 84 positioned to press web 78 against the face 42 of printhead 20 during wiping. Idler rollers 86 help maintain the desired position and tension for web 78. A usually clean, unused web is supplied from spool 80 to blade 84 and dirty, used web collected on take-up spool 82. When web wiping is desired, carriage 14 is parked over service module 44 as shown in FIG. 9. Service module 44 is moved lengthwise along printhead face 42 in the Y direction, as indicated by direction arrow 88 shown in FIG. 10, at the urging of any suitable drive mechanism to supply the wiping motion for web 78. Web 78 is advanced over blade 84 periodically to supply clean web for wiping.

Figure 10:
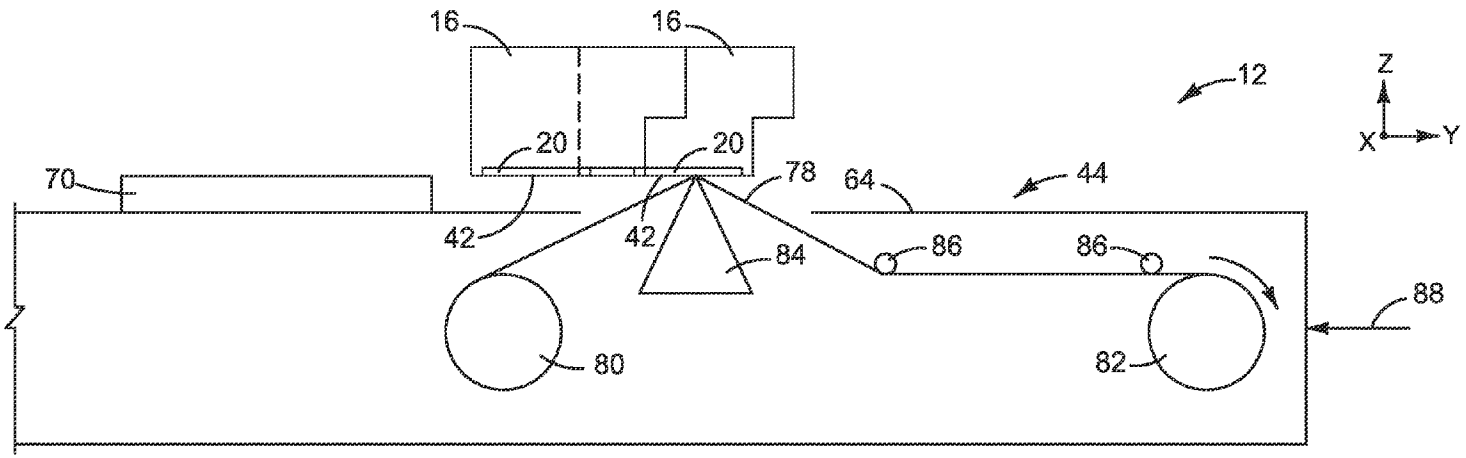
Figure 11:
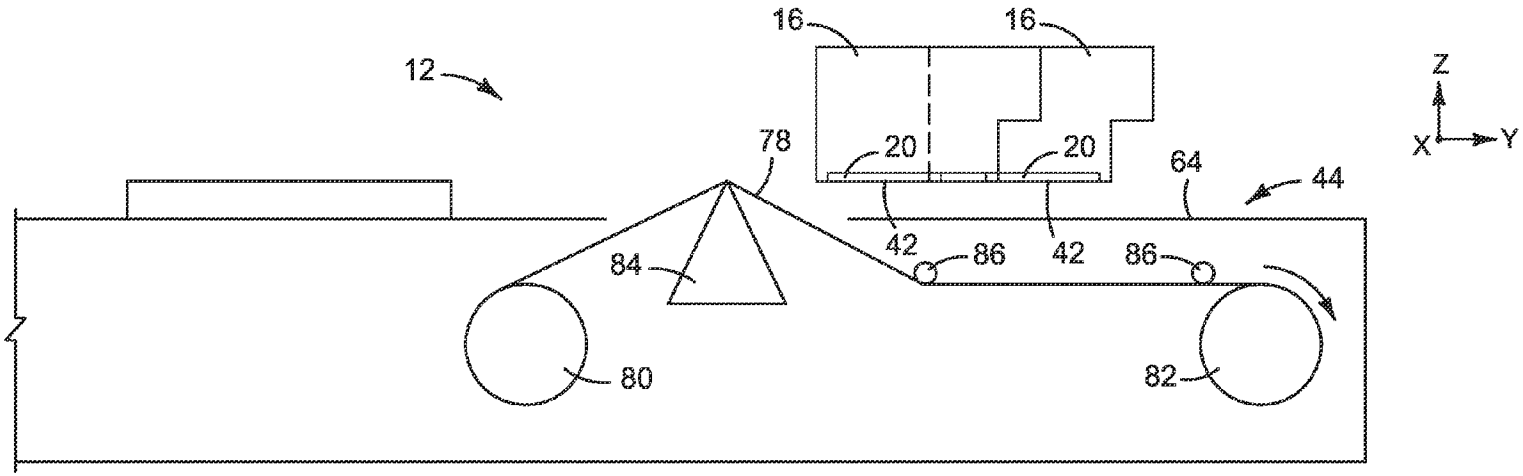
Figure 12:
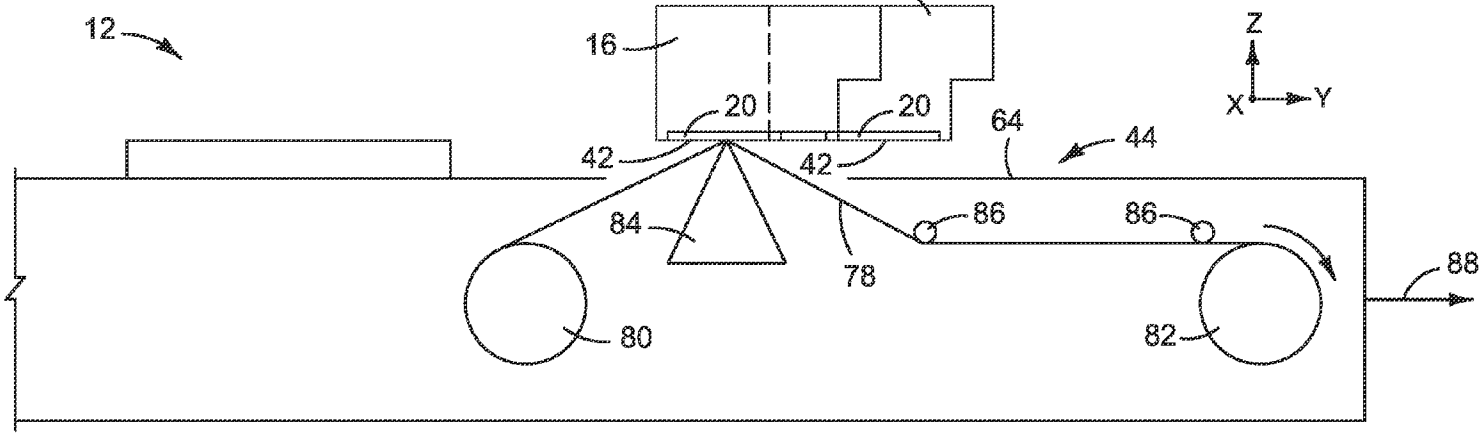

FIG. 9 shows module 44 positioned to place cross wiper blade 70 across the carriage scan path. Two of the overlapping printheads 20 (and corresponding pens 16) are shown in FIG. 9—one from each group of staggered printheads 72, 74 seen in FIG. 7. In FIG. 10, module 44 is moving to the left in the Y direction as indicated by direction arrow 88 to wipe along the face 42 of printheads 18 with cleaning web 78. Module 44 continues to move to the left until cleaning web 78 passes printhead faces 42, as shown in FIG. 11, and then module 44 reverses direction to wipe web 78 back along printhead faces 42 as shown in FIG. 12. Module 44 is returned to the cross wiping position shown in FIG. 9 after the desired number of web wipes are completed.

FIGS. 13-18 illustrate another example of a printhead service module 44 such as might be used in system 12. Referring to FIGS. 13-18, in this example module 44 includes a preliminary wiper 90 that may be used with a cross wiper 40 in system 12, as shown, or without a cross wiper 40 in system 12. Wiper 90 includes a set of helical blades 92 mounted to shafts 94. Any suitable drive mechanism may be used to turn shafts 94 to rotate blades 92. The drive mechanism may include, for example, a single drive belt 96 to drive all shafts 94 simultaneously at the urging of a variable speed motor (not shown) operating at the direction of controller 28 (FIG. 1). Helical wiper blades 92 are spaced apart laterally across service module 44 in the X direction, the direction carriage 14 is scanned back and forth over platen 50 in FIG. 3, to align with printheads 20 when carriage 14 is parked over service module 44. The axis of rotation 98 along each shaft 94 for blades 92 is parallel to the Y direction servicing module 44 is moved for web wiping.

Figure 15:
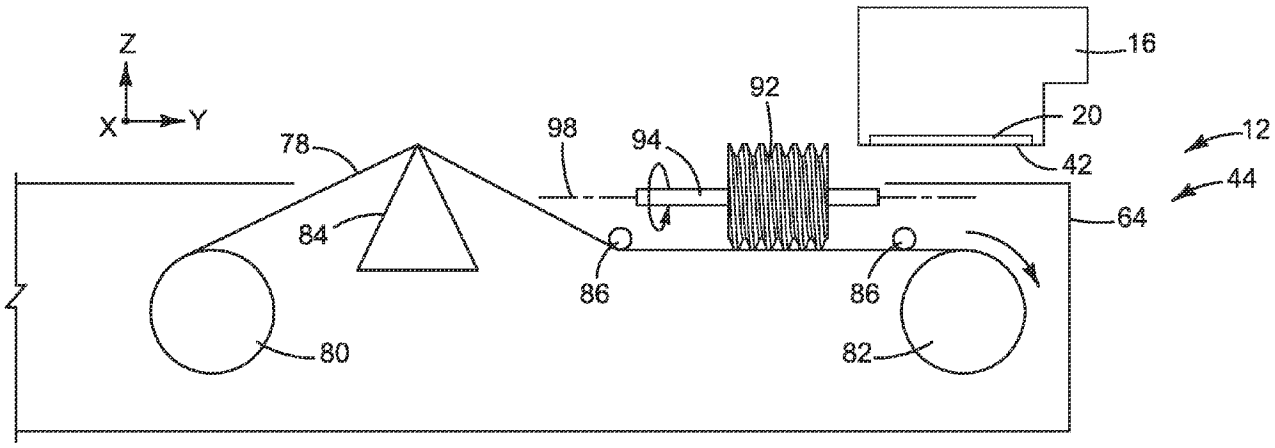
FIGS. 15-18 are side views showing one example of a wiping sequence with the service module of FIG. 13.
Figure 16:
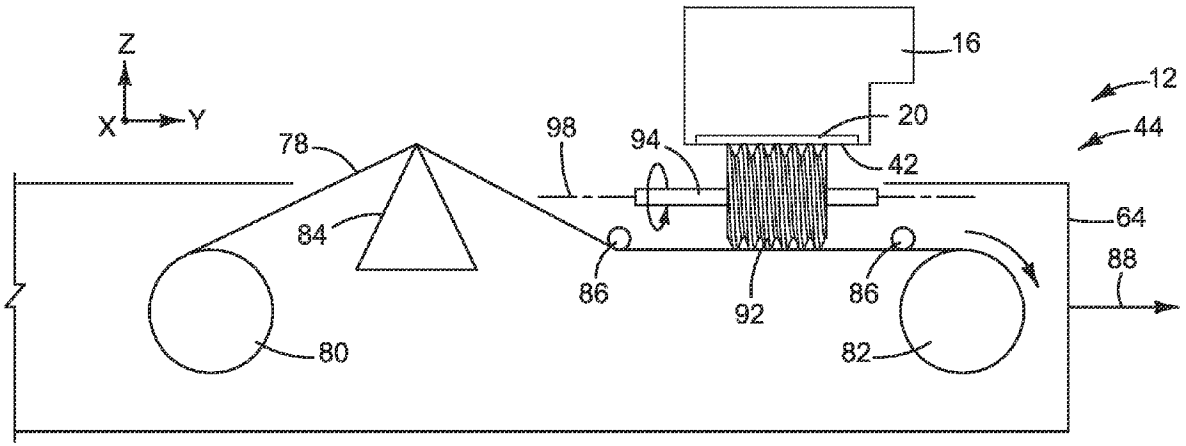
Figure 17:
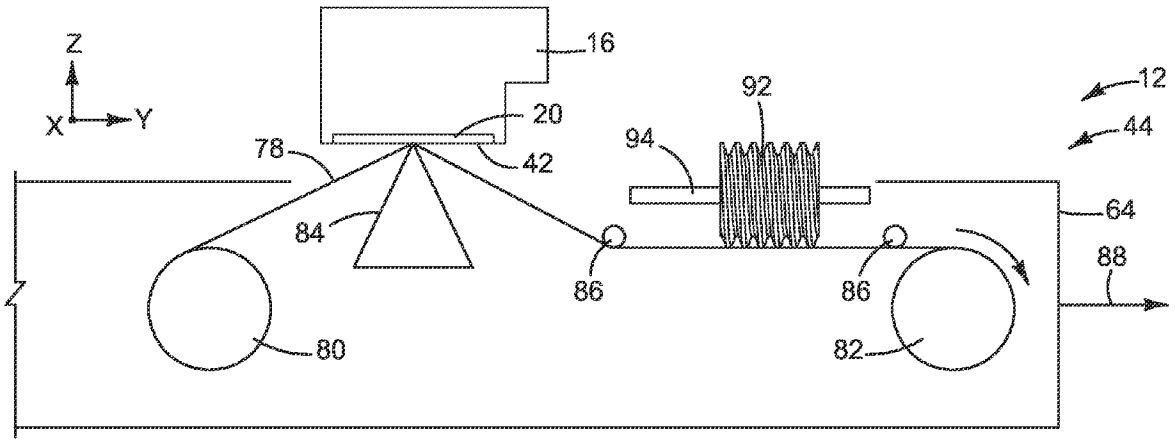
Figure 18:
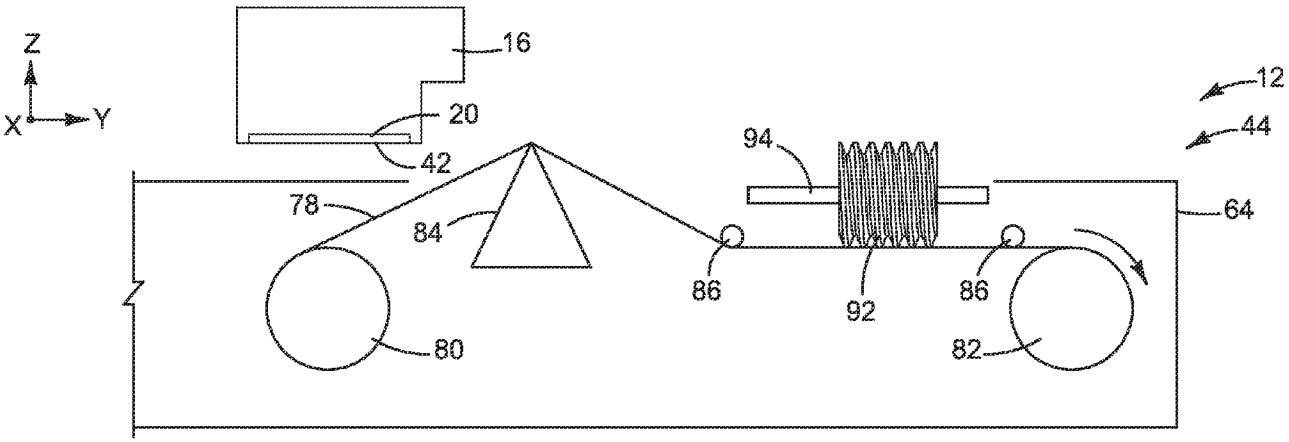

FIG. 15 shows ink pen 16 and corresponding printhead 20 in position near helical wiper blade 92 for pre-wiping printhead face 42. FIGS. 16-18 show the sequence for wiping with web 78. In operation, and referring specifically to FIG. 16, each rotating helical blade 92 pushes ink sideways off printhead face 42 as service module 44 is moving blade 92 along printhead face 42 as indicated by direction arrow 88. As module 44 continues to move in the direction of arrow 88, printhead 20 passes over web wiper blade 84 for wiping with web 78, as shown in FIG. 17, until wiping is complete in FIG. 18. While the rotational and translational speeds of blade 92 may be varied to achieve the desired wiping characteristics, it is expected that blade 92 usually will be rotated very fast relative to its forward motion to generate a cross wiping force pushing laterally to the side of printhead face 42 and to effect multiple cross wipes with each pass of blade 92 along face 42.

Wiping with a rotary, helical preliminary wiper 90 helps remove any puddles of ink that may have accumulated on printhead face 42 to improve the effectiveness of web wiper 38 and without splashing ink on to adjacent parts. Also, in the example shown, helical wiper blade 92 is positioned to contact web 78 so that, as blade 92 rotates against and moves along printhead face 42, it also rubs against web 78 to help remove ink and ink residue that may collect on blade 92 so that blade 92 is clean at each contact with face 42.

It may not be desirable in all printing applications to utilize all three wipers 38, 40 and 90. Thus, for example, in some printers only a web wiper 38 and a cross wiper 40 may be included in service system 12 and module 44, as shown in FIG. 4. For another example, in some printers only a web wiper 38 and helical preliminary wiper 90 may be included in systems 12 and module 44. It may even be desirable in some printing applications to omit web wiper 38, utilizing only a stationary cross wiper 40 or a helical rotary wiper 90 (or both).

Cross wiper blade 70 and helical wiper blades 92 may be made of EPDM (ethylene propylene diene monomer) type rubber or another material suitable for wiping printhead surfaces 42. A softer rubber like EPDM may be desirable for blades 70 and 92 to help reduce the risk of damaging printhead face 42. Also, with a softer EPDM type rubber an acceptable contact and wiping force may be achieved with each blade 70 and 92 interfering with printhead surfaces 42 in the range of 1.0 mm-2.0 mm.

Figure 13:
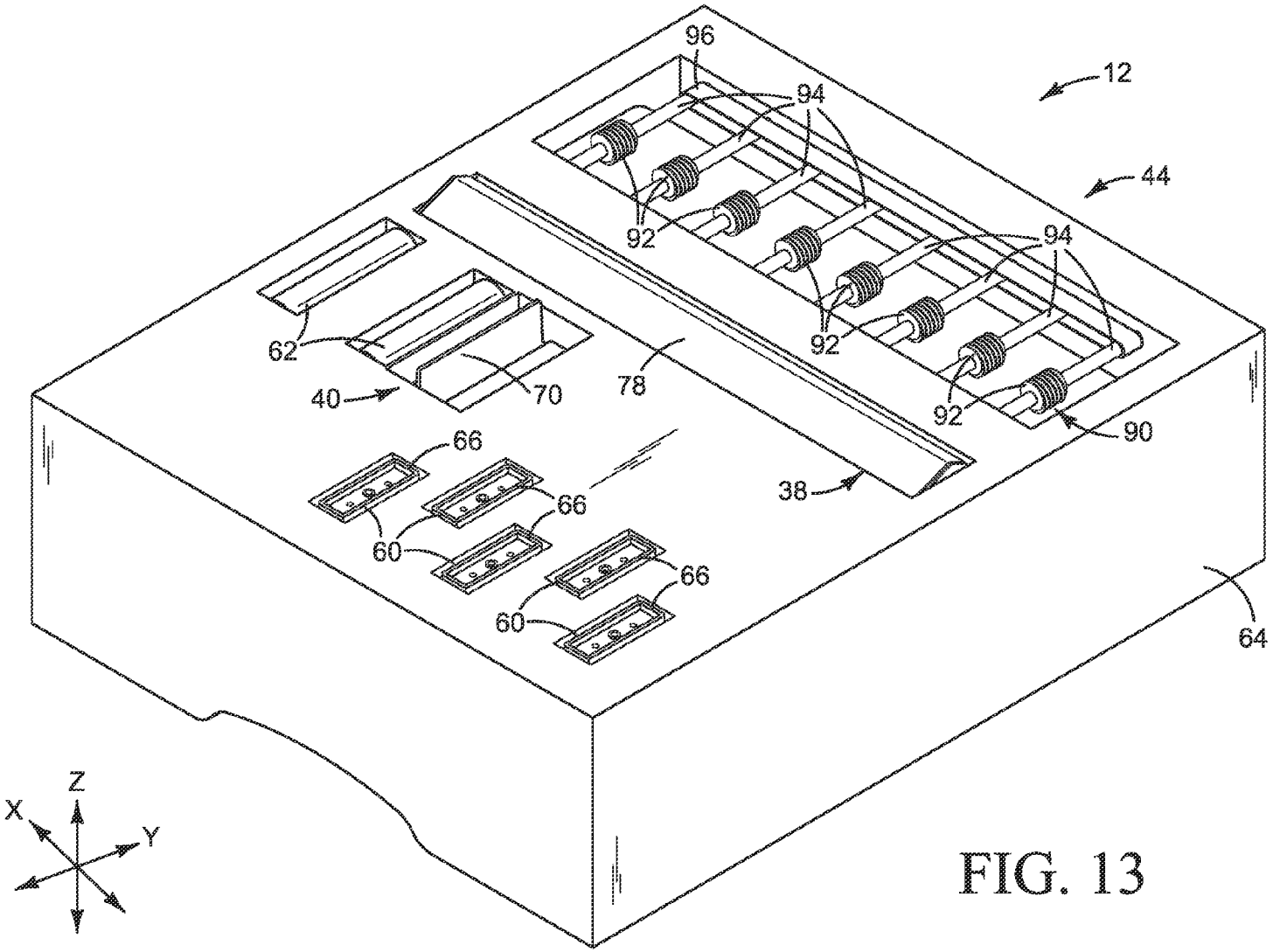
FIG. 13 is a perspective view illustrating another example of a service module that might be used in the printer shown in FIGS. 2 and 3.
Figure 14:
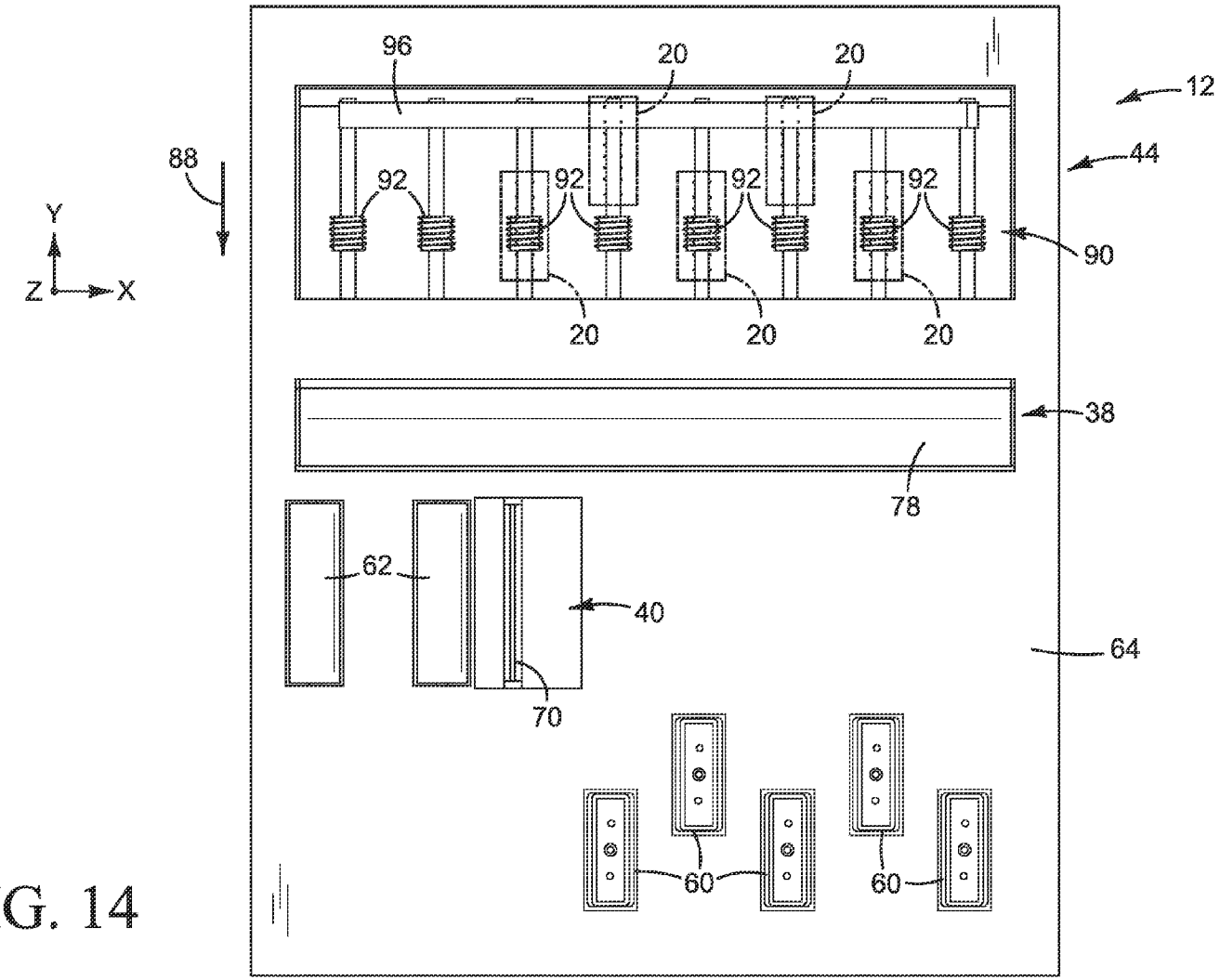
FIG. 14 is a plan view showing printheads over the helical wipers in the service module of FIG. 13.
Figure 19:
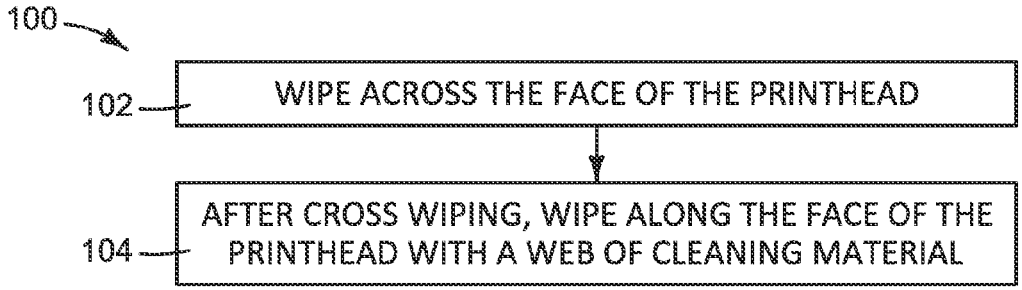
FIGS. 19-21 are flow diagrams illustrating example methods for wiping the face of a printhead such as might be implemented in the service system shown in FIG. 1.

FIG. 19 is a flow diagram illustrating one example of a method 100 for wiping the face of a printhead such as might be implemented in a service system 12 shown in FIG. 1 and in a service module 44 shown in FIGS. 4 and 13. The method of FIG. 19 may be performed, for example, at the direction of controller 28 executing wiping instructions 34. Referring to FIG. 19, a printhead is wiped across its face, for example with a stationary cross wiper 40 or a rotary, helical wiper 90, or both (block 102). After cross wiping at block 102, the printhead is wiped along its face with a web of cleaning material (block 104). Although cross wiping (block 102) and web wiping (block 104) usually will be performed together periodically after multiple passes of the printhead carriage back and forth, other sequences are possible. For example, it may be desirable for some printing operations to perform both wiping steps after each pass back and forth or to perform one of these wiping steps more frequently or less frequently than the other wiping step. Also, it may be desirable to perform one or both cross wiping and web wiping steps with other printhead servicing operations, for example after spitting to prevent or clear clogged nozzles and before or after capping during periods of inactivity.

Figure 20:
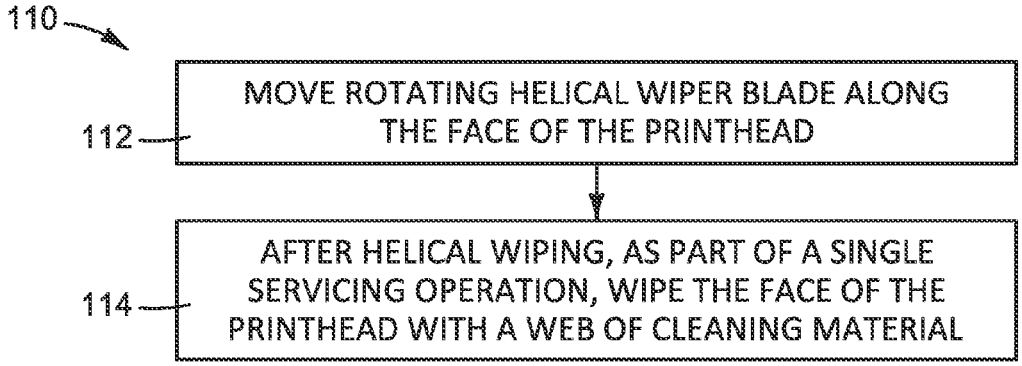

FIG. 20 is a flow diagram illustrating one example of a method 110 for wiping the face of a printhead such as might be implemented in a service system 12 shown in FIG. 1 and in a service module 44 shown in FIG. 13. The method of FIG. 20 may be performed, for example, at the direction of controller 28 executing wiping instructions 34. Referring to FIG. 20, a rotating, helical wiper blade is moved along the face of a printhead (block 112) and then, as part of the same, single printhead servicing operation, the printhead face is wiped with a web of cleaning material (block 114).

Figure 21:
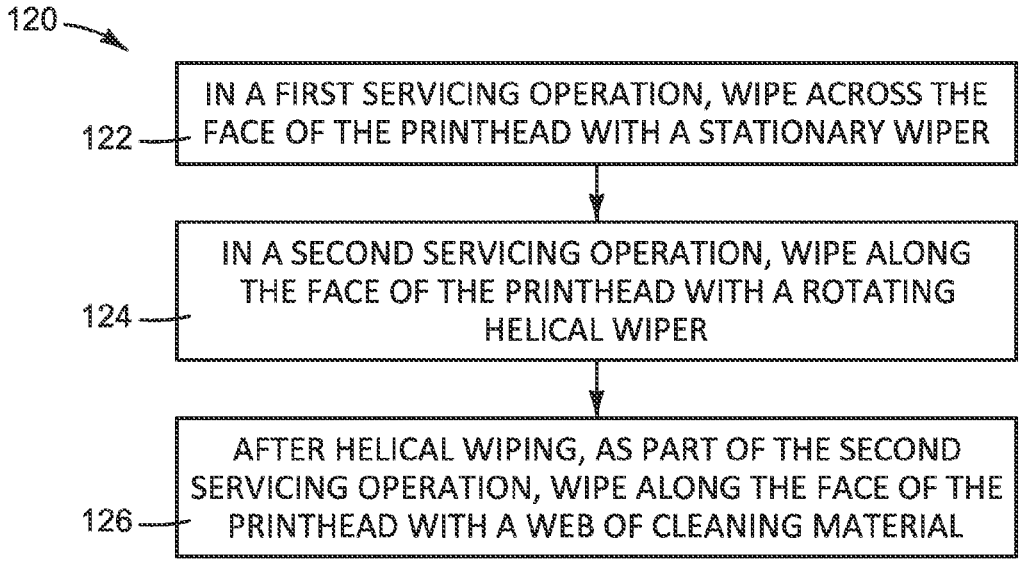

FIG. 21 is a flow diagram illustrating one example of a method 120 for wiping a printhead face such as might be implemented in a service system 12 shown in FIG. 1 and in a service module 44 shown in FIG. 13. The method of FIG. 21 may be performed, for example, at the direction of controller 28 executing wiping instructions 34. Referring to FIG. 21, in a first servicing operation, a printhead is wiped across its face with a stationary cross wiper (block 122). In a second servicing operation, the printhead is wiped along its face of the printhead with a rotating, helical wiper blade (block 124) to push ink off the side of the printhead face and then the printhead face is wiped with a web of cleaning material moving along the face of the printhead (block 126).

"A" and "an" used in the claims means one or more.

As noted at the beginning of this Description, the examples shown in the figures and described above illustrate but do not limit the disclosure. Other examples are possible. Therefore, the foregoing description should not be construed to limit the scope of the disclosure, which is defined in the following claims.

What is claimed is:

1. A wiper for wiping a face of a printhead, the wiper comprising:

a rotatable shaft having an axis of rotation; and a helical blade affixed to the shaft, the helical blade simultaneously rotatable on the shaft against the face of the printhead and translatable along the face of the printhead in a direction parallel to the axis of rotation.

2. The wiper of claim 1 wherein the shaft is mounted in a housing that is movable to translate the blade along the face of the printhead.

3. The wiper of claim 1, wherein the blade is rotatable against the face of the printhead at a first rate and translatable along the face of the printhead at a second rate to generate a wiping force with the blade pushing laterally to one side of the face of the printhead face.

4. The wiper of claim 3, wherein the first rate and the second rate are to cause the blade to rotate through multiple revolutions against the face of the printhead during one pass of the blade along the face of the printhead.

5. The wiper of claim 4, wherein:

the rotatable shaft comprises multiple rotatable shafts each having an axis of rotation parallel to the axis of rotation of the other shafts; and the helical blade comprises multiple helical blades each affixed to one of the shafts for simultaneously wiping the face of multiple printheads, each helical blade simultaneously rotatable on one of the shafts against the face one of the printheads and translatable along the face of the printhead in a direction parallel to the axes of rotation.

6. A system for wiping a face of a movable printhead having a direction of travel along a path, the system comprising:

a first wiper including a web of cleaning material movable in a wiping direction along the face of the printhead perpendicular to the direction of travel; and a second wiper positioned near the first wiper in the wiping direction, the second wiper including:

a rotatable shaft having an axis of rotation extending in the wiping direction; and a helical blade affixed to the shaft, the helical blade simultaneously rotatable on the shaft against the face of the printhead and translatable along the face of the printhead in the wiping direction.

7. The system of claim 6, wherein the second wiper is positioned near the first wiper so that, when the helical blade rotates against and moves along the face of the printhead, the helical blade rubs against the web of cleaning material.

8. The system of claim 6, wherein the first wiper and the second wiper are mounted together in a module that is movable in the wiping direction to move the web and translate the helical blade along the face of the printhead.

9. The system of claim 6, further comprising a third wiper including a stationary blade oriented perpendicular to the direction of travel and spanning the path.

10. The system of claim 9, wherein the first wiper, the second wiper and the third wiper are mounted together in a module that is movable in the wiping direction to move the web and translate the helical blade along the face of the printhead.

11. A method for wiping the face of a printhead, comprising:

wiping across the face of the printhead; and then wiping along the face of the printhead with a web of cleaning material.

12. The method of claim 11, wherein wiping across the face of the printhead comprises moving the face of the printhead across a stationary wiper blade.

13. The method of claim 11, wherein wiping across the face of the printhead comprises moving a rotating helical wiper blade along the face of the printhead.

14. The method of claim 13, further comprising wiping the helical blade with the web of cleaning material simultaneously with moving the rotating helical wiper blade along the face of the printhead.

* * * * *